US005892836A

United States Patent [19]

Ishige et al.

[11] Patent Number: 5,892,836

[45] Date of Patent: Apr. 6, 1999

[54] DIGITAL HEARING AID

[75] Inventors: Ryuuichi Ishige; Reishi Kondo; Yukio Mitome, all of Tokyo, Japan

[73] Assignee: NEC Corporation, Tokyo, Japan

[21] Appl. No.: 738,556

[22] Filed: Oct. 28, 1996

[30] Foreign Application Priority Data

Oct. 26, 1995 [JP] Japan ..... 7-278648

[51] Int. Cl.[6] ..... H04R 25/00

[52] U.S. Cl. ..... 381/316; 381/320

[58] Field of Search ..... 381/68.2, 68.4, 381/68, 98, 312, 316, 320, 321; 128/746; 73/585; 364/724.19

[56] References Cited

U.S. PATENT DOCUMENTS

| | | | |
|---|---|---|---|
| 4,637,402 | 1/1987 | Adelman | 381/68.2 |
| 4,901,353 | 2/1990 | Widin | 381/68.2 |
| 4,941,191 | 7/1990 | Miller et al. | 364/724.19 |
| 4,972,487 | 11/1990 | Mangold et al. | 381/68.2 |
| 4,992,966 | 2/1991 | Widin et al. | 128/746 |
| 5,027,410 | 6/1991 | Williamson et al. | 381/68.4 |
| 5,083,312 | 1/1992 | Newton et al. | 381/68.2 |
| 5,111,419 | 5/1992 | Morley, Jr. et al. | 381/68 |
| 5,193,070 | 3/1993 | Abiko et al. | 364/724.01 |
| 5,230,344 | 7/1993 | Özdamar et al. | 128/746 |
| 5,303,306 | 4/1994 | Brillant et al. | 381/68.4 |
| 5,475,759 | 12/1995 | Sngebretson | 381/68.2 |
| 5,600,728 | 2/1997 | Satre | 381/68.2 |
| 5,604,812 | 2/1997 | Meyer | 381/68.2 |
| 5,608,803 | 3/1997 | Magotra et al. | 381/68 |
| 5,771,299 | 6/1998 | Melanson | 381/316 |
| 5,796,848 | 8/1998 | Martin | 381/316 |

FOREIGN PATENT DOCUMENTS 3-284000 12/1991 Japan .

OTHER PUBLICATIONS

Journal of Acoustic Society of Japan, vol. 47, No. 10, 1991, pp. 778–784.

*Primary Examiner*—Curtis A. Kuntz
*Assistant Examiner*—Xu Mei
*Attorney, Agent, or Firm*—Foley & Lardner

[57] ABSTRACT

A digital hearing aid having a variable hearing compensating characteristics, comprises a hearing compensating circuit having a transposed transversal filter, an analyzer for frequency-analyzing an input signal, a memory storing a hearing characteristics of a person to be fitted with the hearing aid, and a controller receiving a frequency analysis result of the input signal and the hearing characteristics, for deriving coefficients for the transposed transversal filter to supply the derived coefficients to the transposed transversal filter. Since the transposed transversal filter is used, the S/N ration is improved, and the control of the characteristics of the filter becomes easy.

18 Claims, 12 Drawing Sheets

DIGITAL HEARING AID

BACKGROUND OF THE INVENTION

1. Field of the Invention

The present invention relates to a hearing aid utilizing a digital signal processing technology.

2. Description of Related Art

Dysaudia or deafness can be generally classified into a conduction deafness and a perceptive deafness. The conduction deafness is such a condition that sound itself is not sufficiently transmitted because of abnormality of an external ear or middle ear. The conduction deafness can be satisfactorily compensated by a conventional analog hearing aid.

On the other hand, the perceptive deafness is such a condition that it is difficult to sense sound itself because of abnormality of an internal ear. This perceptive deafness is attributable to various causes, for example, lack of stereocilium at a tip end of frondose cells in a cochlea, or a trouble in nerve for transmitting a sound. A senile deafness is included in the perceptive deafness.

This perceptive deafness can be hardly overcome by the conventional analog hearing aid, and attention is being focused on a digital hearing aid capable of realizing a complicated signal processing.

In addition, the perceptive deafness exhibits various symptoms, each of which is greatly different from one person to another. One main symptom of the perceptive deafness includes a loudness recruitment phenomenon, in which a minimum level capable of hearing (minimum threshold of audibility) elevates, but a maximum level (maximum threshold of audibility) does not change much, with the result that an audible range is narrowed. This change is different from one frequency to another.

As a means for overcoming the above problem, it is a conventional practice to compress a dynamic range of an input sound, which is disclosed by, for example, Journal of Acoustic Society of Japan, Vol. 47, No. 10, pp 778–784, 1991 and Japanese Patent Application Laid-open Publication No. JP-A-3-284000.

Referring to FIG. 1, there is shown a block diagram illustrating the digital hearing aid disclosed by the first referred publication. The digital hearing aid shown in FIG. 1, which will be called a "first prior art example" in this specification, is so configured that an input signal obtained through an input 100 is divided by a low pass filter 102, a band pass filter 104 and a high pass filter 106 into three different frequency component, which are, in turn, analog-to-digital converted and distributed by a multiplexer and analog-to-digital converter 108 to a low frequency band gain setting circuit 110, a middle frequency band gain setting circuit 112 and a high frequency band gain setting circuit 114. Outputs of these gain setting circuits are supplied through digital-to-analog converters 116, 118 and 120 to smoothing filters 122, 124 and 126, respectively. Outputs of smoothing filters are combined by an adder 128, and then, supplied through an output limiter and power amplifier 130 to an output 132.

With this arrangement, an arbitrary input-to-output characteristics in each of the different frequency bands can be realized independently of the other frequency bands, so that an output signal confined within an arbitrary desired dynamic range is outputted for a hearing compensation.

Referring to FIG. 2, there is shown a block diagram illustrating the digital hearing aid disclosed by Japanese Patent Application Laid-open Publication No. JP-A-3-284000. The digital hearing aid shown in FIG. 2, which will be called a "second prior art example" in this specification, is so configured that an input signal obtained through an input 200 is analog-to-digital converted by an analog-to-digital converter 202, and then, supplied to a frequency sampling structure filter 204, whose output is digital-to-analog converted by a digital-to analog converter 206, and then, supplied to an output 208. Furthermore, an output of the analog-to-digital converter 202 is subjected to a short-time Fourier analysis in a short-time Fourier analyzing circuit 210, and Fourier coefficients obtained in the short-time Fourier analyzing circuit 210 are time-averaged by Fourier coefficient averaging circuits 212A, 212B, . . . , 212N. Averaged Fourier coefficients "$a_1$", "$a_2$", . . . "$a_n$" are supplied to loudness mapping functions circuits 214A, 214B, . . . , 214N, respectively, which, in turn, output gains "$g_1$", "$g_2$", . . . "$g_n$" required for the frequency sampling structure filter 204. Thus, a loudness is compensated for a hearing compensation.

As seen from the above, in order to compensate for the recruitment in the perceptive deafness, the hearing aid is required to convert an input signal, which varies in frequency and strength, into an output signal in matching with a hearing characteristics of a person to be fitted with the hearing aid. Therefore, a time-variant filter is used in the digital hearing aid to change the characteristics of the hearing aid in response to both the input signal and the hearing characteristics of the person to be fitted with the hearing aid.

In the first prior art example, however, since the input signal is divided into only three frequency bands, the hearing aid cannot meet with all different hearing characteristics of various deaf persons. In addition, if the three frequency band signals become out of phase, naturality of an outputted voice is deteriorated or lost.

On the other hand, since the second prior art example uses the frequency sampling structure filter as a hearing compensating filter, the following problems have been encountered. In the frequency sampling structure filter, a frequency component of the input signal is made small in the proximity of a "zero" but large at a "pole". This results in a drop of a S/N ratio, because of a calculation precision of a finite length.

Furthermore, in the case of changing the characteristics of the frequency sampling structure filter, it is necessary to change the filter coefficients at the same as a finite impulse response of the filter of the firstly set characteristics is ended. Otherwise, the impulse response changes in the way, so that the characteristics itself of the filter changes, with the result that a firstly determined characteristics cannot be found. Accordingly, at the time of changing the characteristics of the hearing compensating filter, it is necessary to monitor the impulse response of the filter or to perform the calculation of the impulse response, and therefore, the control becomes difficult.

In addition, since the frequency sampling structure filter has only control points distributed over a frequency with equal frequency intervals; the degree of freedom in design is low. In order to obtain a desired characteristics, it is necessary to increase the number of control points, namely to elevate the order of the filter, which results in an increased amount of calculation.

SUMMARY OF THE INVENTION

Accordingly, it is an object of the present invention to provide a digital hearing aid which has overcome the above mentioned defects of the conventional ones.

Another object of the present invention is to provide a digital hearing aid having an improved S/N ratio and capable of easily controlling the characteristics of a time-variant filter.

Still another object of the present invention is to provide a digital hearing aid capable of always outputting a natural output voice.

A further object of the present invention is to provide a digital hearing aid having no necessity of calculation for obtaining coefficients controlling the digital filters.

The above and other objects of the present invention are achieved in accordance with the present invention by a digital hearing aid having a variable hearing compensating characteristics, comprising a hearing compensating means having a transposed transversal filter receiving an input signal, for outputting a compensated output signal, an analyzing means receiving the input signal for frequency-analyzing the input signal, a memory means for storing a hearing characteristics of a person to be fitted with the hearing aid, and a control means receiving a frequency analysis result of the input signal from the analyzing means and the hearing characteristics from the memory means, for deriving coefficients for the transposed transversal filter to supply the derived coefficients to the transposed transversal filter. This is called a first aspect of the present invention.

In the above mentioned hearing aid in accordance with the present invention, the control means is configured to estimate a plurality of parallel-connected linear phase filters having different pass bands but each having the same structure as that of the transposed transversal filter; to obtain a weight of each of the linear phase filters from the hearing characteristics of the person to be fitted with the hearing aid and the frequency analysis result of the input signal; and to multiply coefficients of each of the linear phase filters by a corresponding weight and to mutually add corresponding coefficients of the linear phase filters so as to determine a coefficients for the transposed transversal filter. This is called a second aspect of the present invention.

In this second aspect of the present invention, the coefficients of each of the linear phase filters can be determined from a coefficient table. This is called a third aspect of the present invention.

Furthermore, in the second aspect of the present invention, the coefficients of each of the linear phase filters can be calculated from one or more filter parameters which determined the characteristics of the respective linear phase filter. This is called a fourth aspect of the present invention.

In the above second, third and fourth aspects of the present invention, preferably, respective center frequencies of the imaginary linear phase filters having the different pass bands are separated from one another with unequal (namely different) frequency intervals. This is called a fifth aspect of the present invention.

Furthermore, in the above second, third, fourth and fifth aspects of the present invention, respective center frequencies of the imaginary linear phase filters having the different pass bands are preferably equal to measurement frequencies of the hearing characteristics of the person to be fitted with the hearing aid. This is called a sixth aspect of the present invention.

Alternatively, in the above mentioned hearing aid in accordance with the first aspect of the present invention, the control means is configured to set a frequency characteristics of the transposed transversal filter on the basis of the frequency analysis result of the input signal and the hearing characteristics of the person to be fitted with the hearing aid, and to inverse-Fourier-transform the set frequency characteristics so as to calculate an impulse response thereby to calculate coefficients of the transposed transversal filter. This is called a seventh aspect of the present invention.

Furthermore, in the first, second, third, fourth, fifth, sixth and seventh aspects of the present invention, the control means is so configured to calculate the impulse response of the transposed transversal filter, on the basis of the frequency characteristics of the transposed transversal filter determined on the basis of the frequency analysis result of the input signal and the hearing characteristics of the person to be fitted with the hearing aid, to calculate a time length of a window from an attenuation of an envelope of the calculated impulse response, to put the window having the calculated time length on the impulse response, and to calculate coefficients of the transposed transversal filter. This is called an eighth aspect of the present invention.

As mentioned above, the digital hearing aid in accordance with the first aspect of the present invention uses the transposed transversal filter as the hearing compensating filter. Referring to FIG. 3, there is shown a block diagram of the transposed transversal filter, which is well known to persons skilled in the art. This transposed transversal filter is composed of a repetition of such a unitary structure that an input signal is multiplied by a coefficient and is added to an output of a preceding delay stage, and a result of addition is outputted to a succeeding delay stage. To the contrary a conventional transversal filter, which is also well known to persons skilled in the art, is such that an output of each of a plurality of delays is multiplied by a corresponding coefficient and all multiplication results are added. Therefore, the flow of data in the conventional transversal filter is opposite to that in the transposed transversal filter. Therefore, even if the input signal is analyzed to determine the characteristics during a constant period starting from a certain moment and then the filter coefficients are changed, the change of the filter coefficients in the transposed transversal filter gives no influence to the input signal before the change of the filter coefficients. Therefore, the characteristics of the filter can be easily controlled as a time-variant system.

Furthermore, the transposed transversal filter does not have such a necessity that the input signal is made small in proximity of the "zero" but large at the "pole", as required in the frequency sampling structure filter of the second prior art example. Therefore, there is no deterioration of the S/N ratio caused because of the calculation precision of the finite length.

In the second aspect of the present invention, the plurality of parallel-connected linear phase filters having different pass bands are estimated, and the weight of each of the linear phase filters is determined on the basis of the hearing characteristics of the person to be fitted with the hearing aid and the frequency analysis result of the input signal, and each of coefficients of each of the linear phase filters is multiplied by a corresponding weight, and furthermore, corresponding coefficients of the linear phase filters are mutually added so as to determine coefficients for the transposed transversal filter. Therefore, a voice distortion caused by combining the signals different in phase, as in the first prior art example, never occurs.

In the third aspect of the present invention, since the coefficients of each of the linear phase filters, which are used for calculating the coefficients for the transposed transversal filter, are obtained from the coefficient table, the amount of calculation required to calculate the coefficients for the transposed transversal filter, is reduced.

On the other hand, in the fourth aspect of the present invention, since the coefficients of each of the linear phase filters, which are used for calculating the coefficients for the transposed transversal filter, are derived by calculation, the memory for storing the coefficients of each of the linear phase filters is no longer necessary, and therefore, it is possible to downsize or miniaturize the hearing aid.

In the fifth aspect of the present invention, since the transposed transversal filter having a high degree of freedom is used as the hearing compensating filter, the hearing compensating filter can be caused to match the hearing characteristics of the person to be fitted with the hearing aid, by setting, with unequal frequency intervals, the center frequencies of the linear phase filters which are used for calculating the coefficients for the transposed transversal filter.

In the sixth aspect of the present invention, since the center frequencies of the linear phase filters, which are used for calculating the coefficients for the transposed transversal filter, are set to be equal to measurement frequencies of the hearing characteristics of the person to be fitted with the hearing aid, it is also possible to match the hearing characteristics of the person to be fitted with the hearing aid.

In the seventh aspect of the present invention, since the frequency characteristics of the transposed transversal filter are determined on the basis of the frequency analysis result of the input signal and the hearing characteristics of the person to be fitted with the hearing aid, and since the determined frequency characteristics are inverse-Fourier-transformed to calculate an impulse response thereby to calculate coefficients of the transposed transversal filter, the processing for determining the characteristics of the hearing compensating filter and the calculation processing for the hearing compensating filter can be reduced.

In the eight aspect of the present invention, the frequency characteristics of the hearing compensating filter is determined on the basis of the frequency analysis result of the input signal and the hearing characteristics of the person to be fitted with the hearing aid, and the impulse response of the hearing compensating filter is determined form the obtained frequency characteristics. In the case that the frequency characteristics of the hearing compensating filter exhibits a gradual change in frequency, the hem or foot of the impulse response does not spread, and therefore, the impulse response can be cut off in the way by a window processing. Therefore, the time length of the window is calculated from the attenuation envelope of the impulse response, and the impulse response is window-processed, and the coefficients for the transposed transversal filter are calculated on the basis of the window-processed impulse response. Thus, the amount of calculation can be reduced.

The above and other objects, features and advantages of the present invention will be apparent from the following description of preferred embodiments of the invention with reference to the accompanying drawings.

DESCRIPTION OF THE PREFERRED EMBODIMENTS

Figure 4:
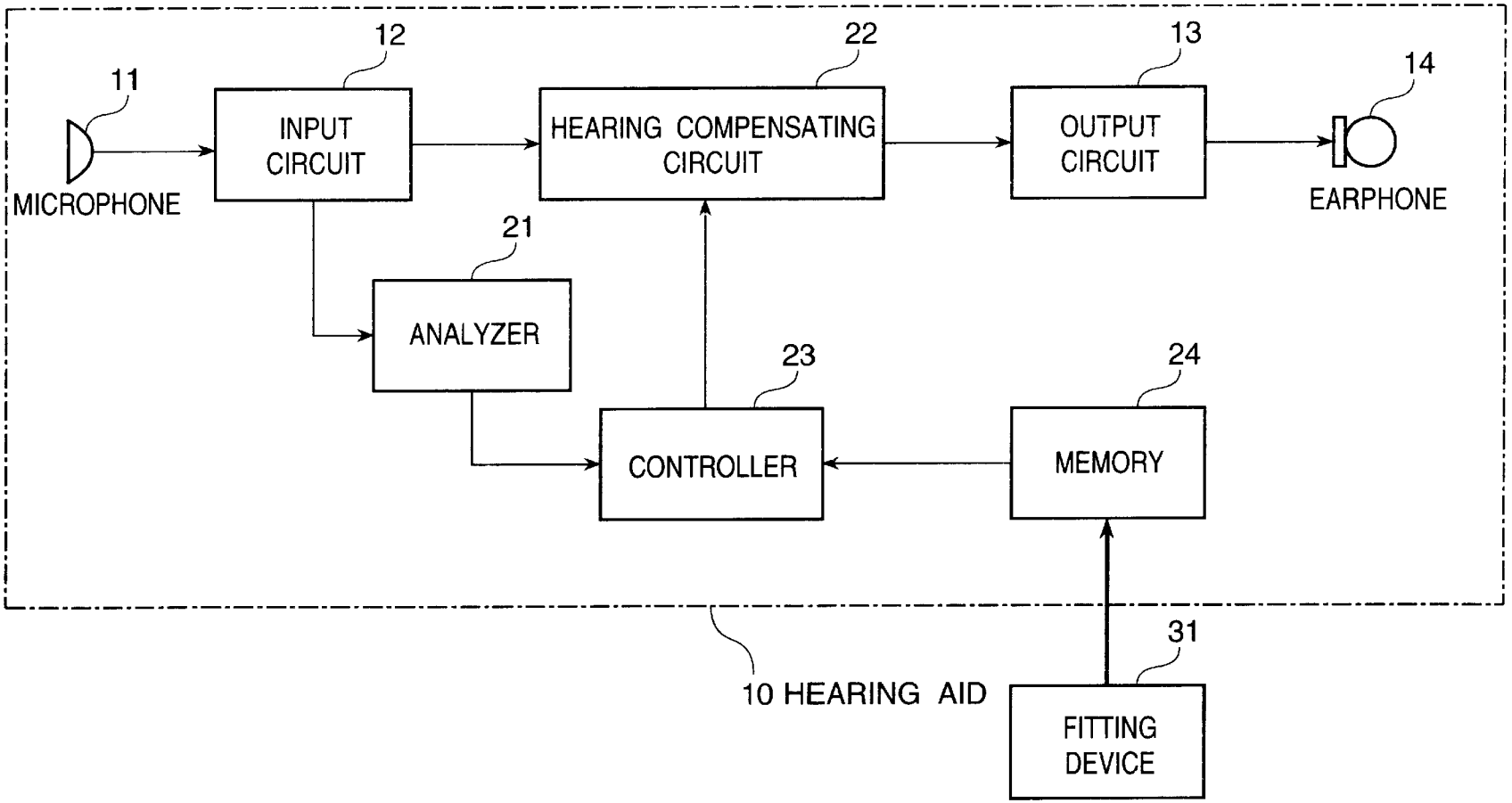
FIG. 4 is a block diagram of an embodiment of the digital hearing aid in accordance with the first aspect of the present invention.

Referring to FIG. 4, there is shown a block diagram of an embodiment of the digital hearing aid in accordance with the first aspect of the present invention.

The shown digital hearing aid is generally designated with Reference Numeral 10, and includes a microphone 11 outputting an analog audio signal in response to a received sound, and an input circuit 12 receiving the analog audio signal, for converting the analog audio signal into a digital signal. Here, the digital audio signal may be buffered if it is required for a processing in a succeeding hearing compensating filter.

The digital audio signal is supplied to an analyzer 21 and a hearing compensating circuit 22. In the analyzer 21, the digital audio signal is frequency-analyzed. This frequency analysis can be realized by any one of various methods including an analysis using a plurality of filters, an analysis utilizing a fast Fourier transformation, a linear prediction analysis, and a cepstrum analysis. A frequency spectrum or a parameter indicative of the frequency spectrum is determined as the analysis result, which is supplied to a controller 23.

The shown digital hearing aid further includes a memory 24 which previously stores hearing characteristics of a person to be fitted with the hearing aid, and the hearing characteristics supplied from the memory 24 to the control 23. Here, the memory 24 can have a function for communicating with a fitting device 31, or alternatively, may be removable as a ROM, which can be removed from the hearing aid 10, and then, written with a hearing characteristics of a person to be fitted with the hearing aid, and thereafter is mounted back into the hearing aid 10.

Figure 1:
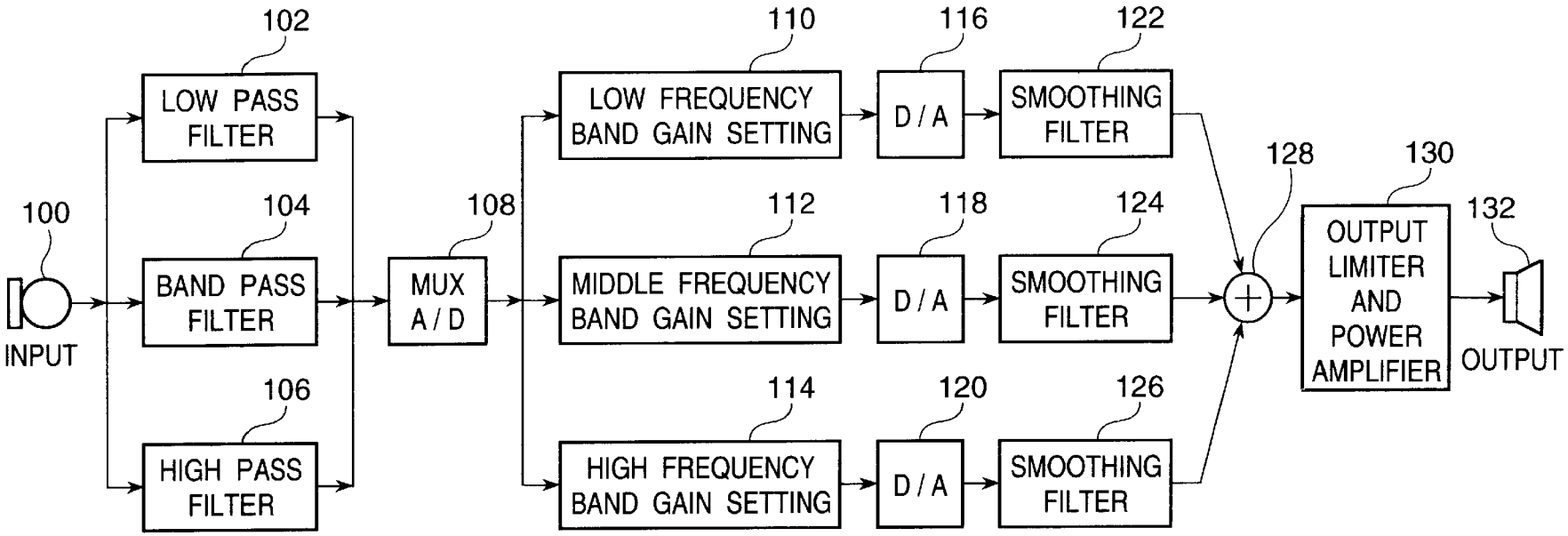
FIGURE 1 PRIOR ART
FIG. 1 is a block diagram illustrating the first prior art example of the digital hearing aid.
Figure 2:
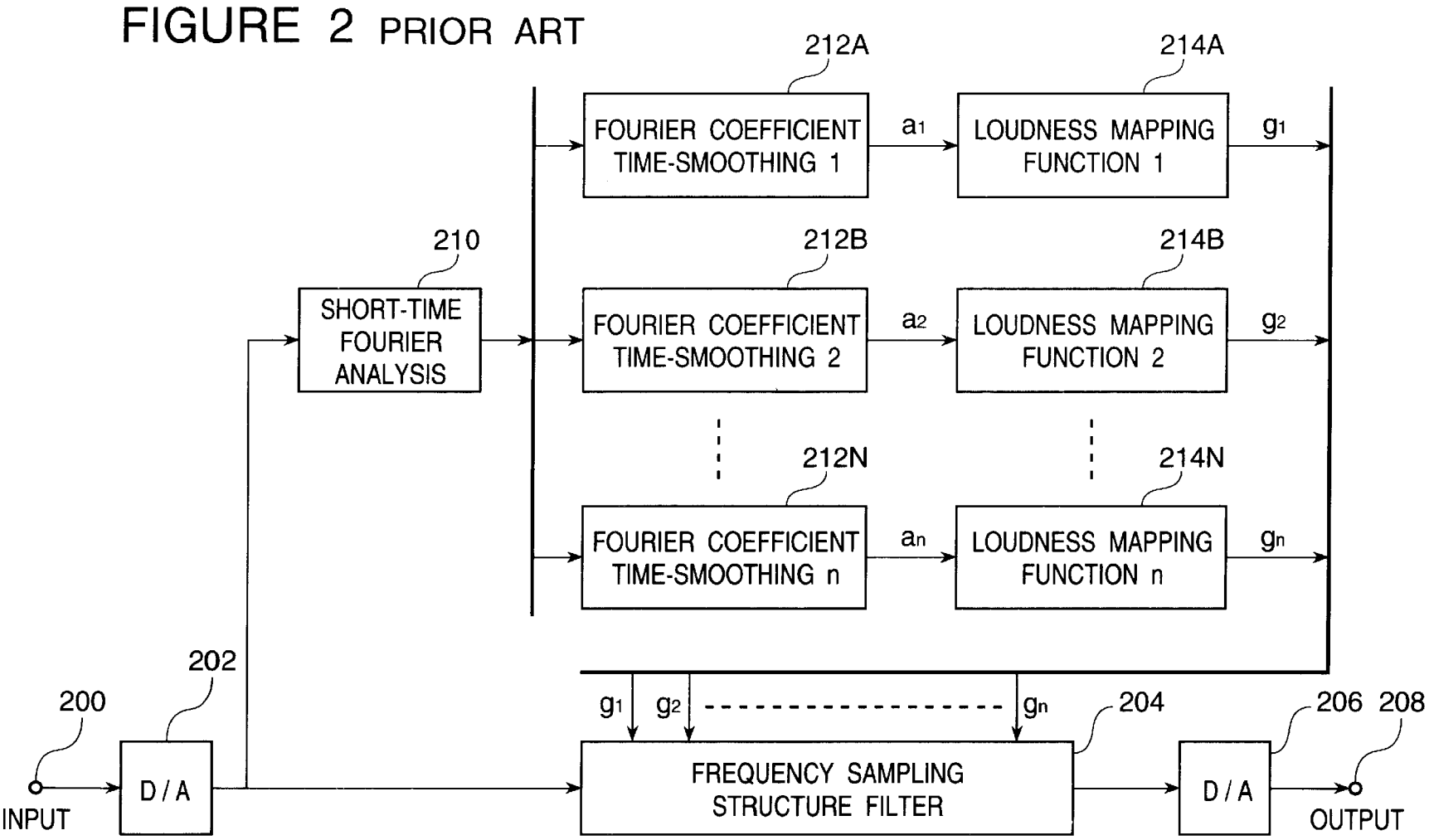
FIGURE 2 PRIOR ART
FIG. 2 is a block diagram illustrating the second prior art example of the digital hearing aid.
Figure 3:
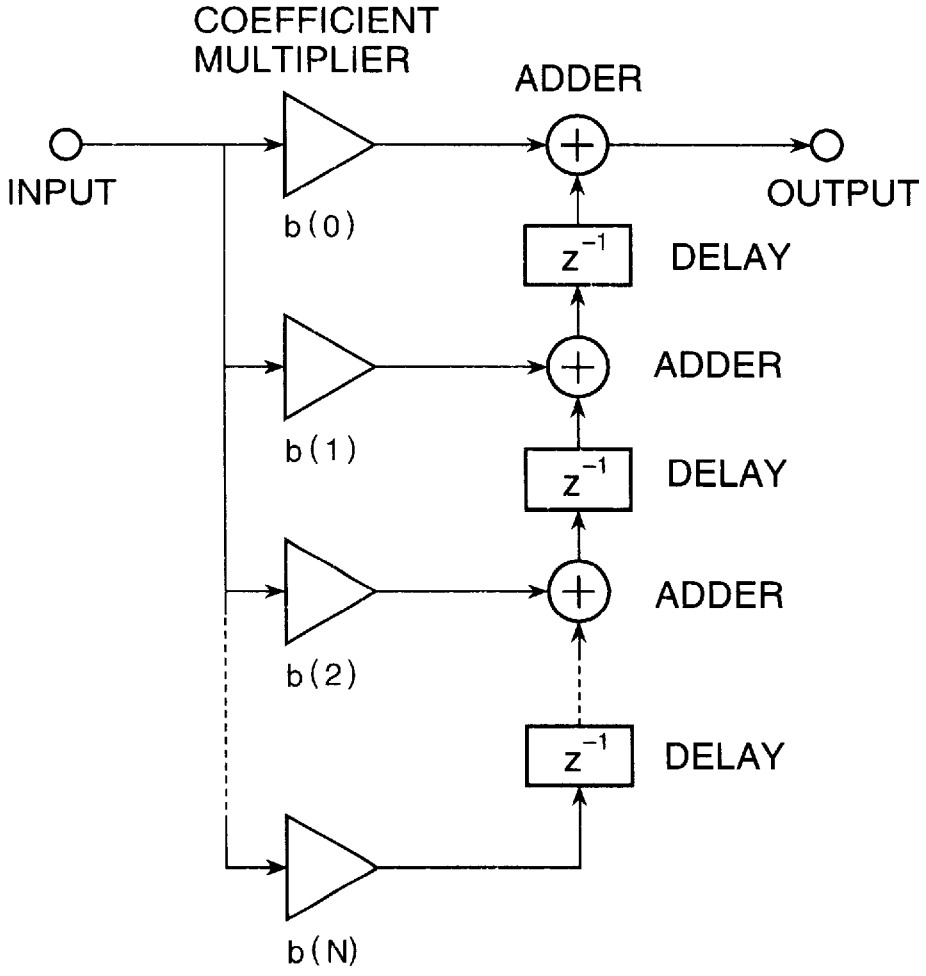
FIG. 3 illustrates a basic structure of the transposed transversal filter.

On the basis of the analysis result outputted from the analyzer and the hearing characteristics of the person to be fitted with the hearing aid, the controller 23 determines coefficients for a transposed transversal filter as shown in FIG. 3, which is the hearing compensating filter constituting the hearing compensating circuit 22. The coefficients determined in the controller 23 are supplied to the hearing compensating circuit 22, in which the characteristics of the transposed transversal filter is changed.

This hearing compensating circuit 22 is configured to cause the input audio signal to match with the narrowed dynamic range of the person fitted with the hearing aid, by use of the transposed transversal filter.

Accordingly, the digital audio signal supplied to the hearing compensating circuit 22 is subjected to the above mentioned hearing compensating processing, by the transposed transversal filter which is the hearing compensating filter, and thereafter, supplied to an output circuit 13. In this output circuit 13, the hearing-compensating-processed digital signal is converted into an analog signal, which is outputted to an earphone 14, which outputs a sound signal.

In this first aspect of the present invention, since the transposed transversal filter is used as the hearing compensating filter, the S/N ratio can be improved, and in addition, the characteristics of the filter can be easily controlled as a time-variant system.

Figure 5:
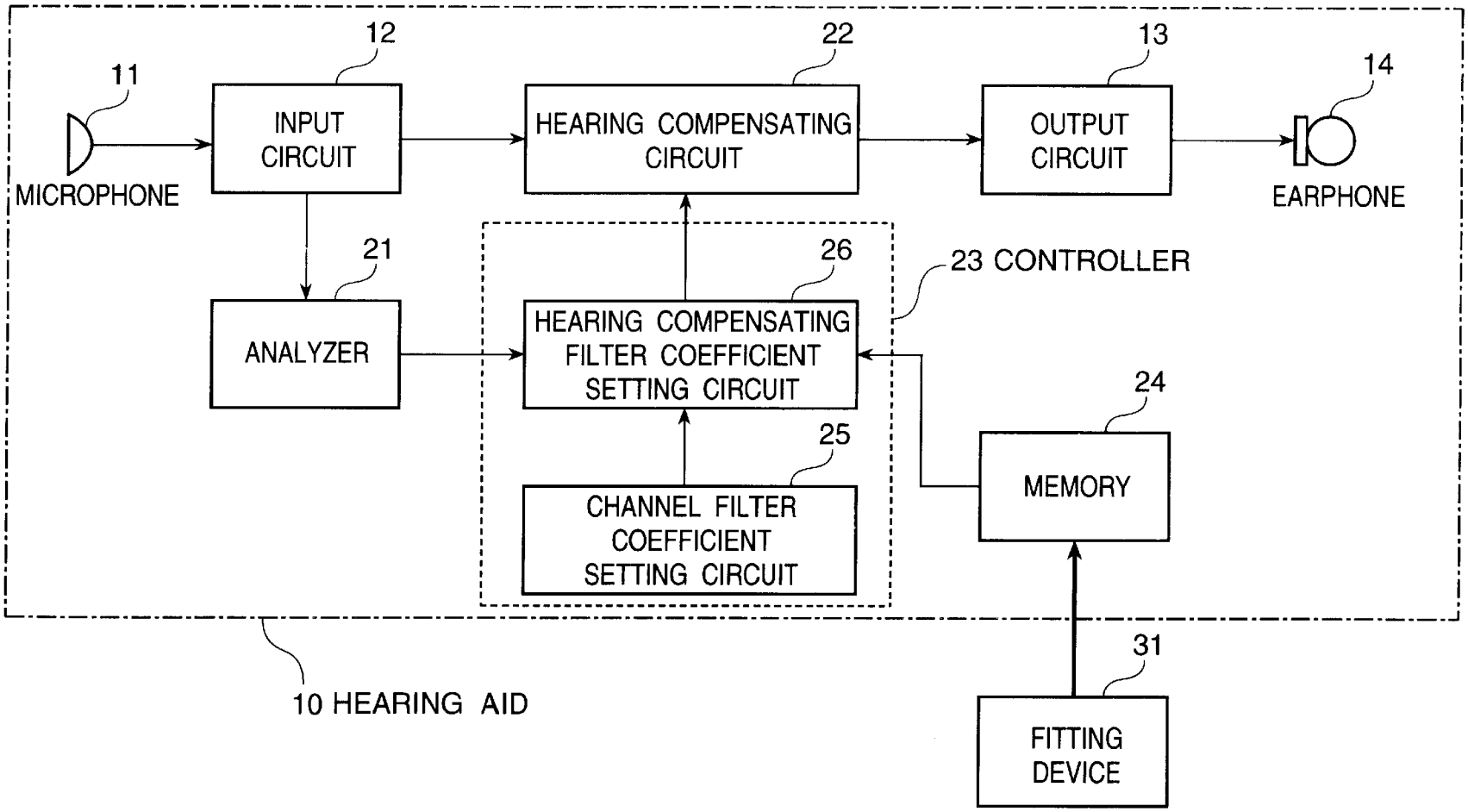
FIG. 5 is a block diagram of an embodiment of the digital hearing aid in accordance with the second aspect of the present invention.

Next, an embodiment of the second aspect of the present invention will be described with reference to FIGS. 5, 3 and 6. In FIG. 5, elements corresponding to those shown in FIG. 4 are given the same Reference Numerals, and explanation thereof will be omitted for simplification of description.

As seen from comparison between FIGS. 4 and 5, in the embodiment of the second aspect of the present invention, the controller 23 includes a channel filter coefficient setting circuit 25 and a hearing compensating filter coefficient setting circuit 26.

In this embodiment, the coefficients of the hearing compensating filter included in the hearing compensating circuit 22, are obtained by a weighting addition of coefficients of a plurality of estimated or imaginary linear phase FIR (finite impulse response) filters having different pass bands but connected in parallel to one another.

For this purpose, each of the estimated or imaginary linear phase FIR filters has the same construction as that of the hearing compensating filter (namely, transposed transversal filter) shown in FIG. 3. Coefficients of each linear phase FIR filter are set by the channel filter coefficient setting circuit 25, to have frequency characteristics as shown in FIG. 6, and then, are supplied to the hearing compensating filter coefficient setting circuit 26. In the graph of FIG. 6, the axis of ordinates indicates the amplitude characteristics of each linear phase FIR filter, and the axis of abscissas shows frequency characteristics. In order to distinguish a plurality of imaginary parallel-connected FIR filters from one another, these imaginary FIR filters are designated with "CHANNEL 1", "CHANNEL 2", . . . , "CHANNEL K". These plurality of parallel-connected FIR filters "CHANNEL 1", "CHANNEL 2", . . . , "CHANNEL K" include only band-pass filters, and therefore, are not required to include a low pass filter and a high pass filter. Therefore, in the shown embodiment, K parallel-connected imaginary linear phase FIR filters are estimated.

On the other hand, the hearing compensating filter coefficient setting circuit 26 receives the analysis result form the analyzer 21, the hearing characteristics of the person to be fitted with the hearing aid, from the memory 24, and the coefficients for the plurality of imaginary linear phase FIR filters from the channel filter coefficient setting circuit 25. On the basis of the analysis result and the hearing characteristics of the person to be fitted with the hearing aid, the hearing compensating filter coefficient setting circuit 26 determines a weight for each of the linear phase FIR filters, and then, weights the coefficients of the linear phase FIR filters by multiplying the coefficients by the corresponding obtained weight, in accordance with the following equation (1):

$$b(n) = \sum_{k=1}^{K} a(k)b(n,k) \tag{1}$$

where n=0, 1, . . . , N, and K and N are integer larger than 1

Figure 6:
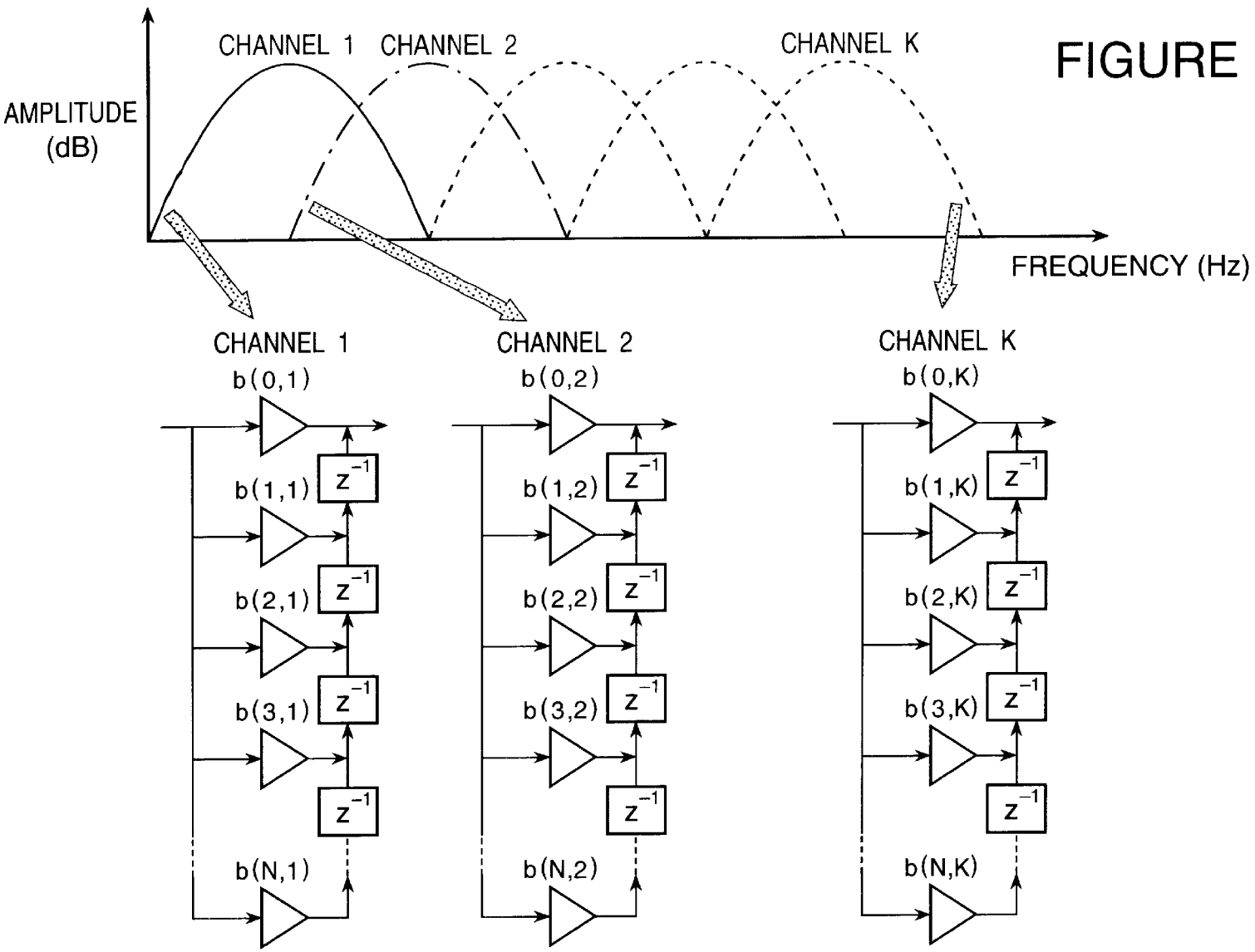
FIG. 6 illustrates an example of the calculation for the transposed transversal filter in the present invention.

Here, b(0), b(1), . . . , b(N) are coefficients of the hearing compensating filter shown in FIG. 6. b(0,1), b(1,1), . . . , b(N,1), b(0,2), b(1,2), . . . , b(N,K) are respective coefficients of the above mentioned plurality of imaginary linear phase FIR filters shown in FIG. 6, and determined in the channel filter coefficient setting circuit 25 shown in FIG. 5. a(1), a(2), . . . , a(K) are weights for the respective linear phase FIR filters, which are determined on the basis of the analysis result and the hearing characteristics (stored in the memory 24) of the person to be fitted with the hearing aid, by means of the hearing compensating filter coefficient setting circuit 26.

In the hearing compensating circuit 22, the filter characteristics of the transposed transversal filter (which is the heating compensating filter) are modified in accordance with the coefficients thus obtained of the hearing compensating filter.

In the above mentioned second aspect of the present invention, since a plurality of linear phase filters having different pass bands are used or estimated in order to calculate the coefficients of the hearing compensating filter, unnaturality of the output voice can be eliminated. This is a further advantage in addition to the advantage of the first aspect of the present invention.

Figure 7:
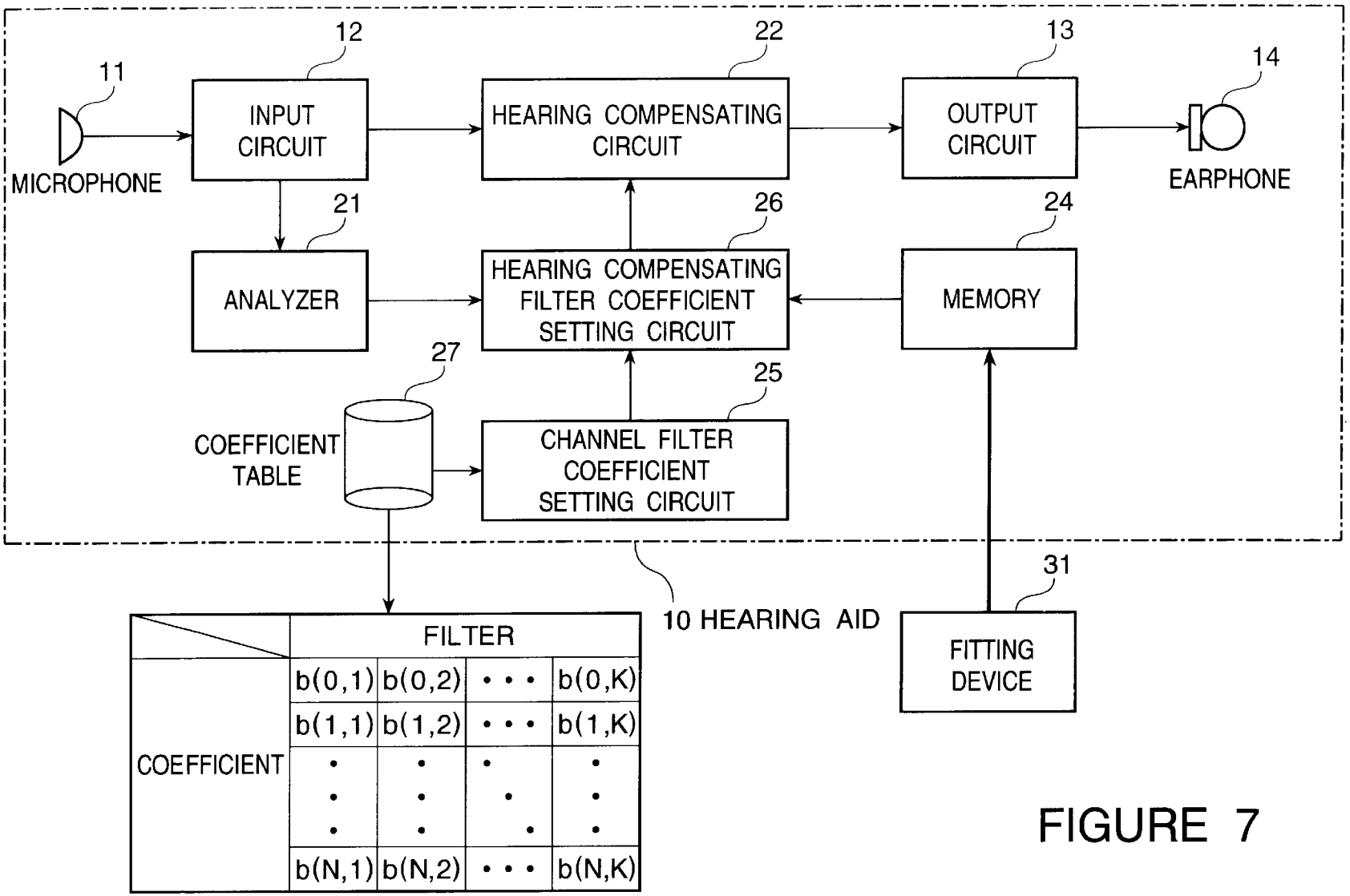
FIG. 7 is a block diagram of an embodiment of the digital hearing aid in accordance with the third aspect of the present invention.

Now, an embodiment of the third aspect of the present invention will be described with reference to FIG. 7, which is a block diagram of an embodiment of the digital hearing aid in accordance with the third aspect of the present invention. In FIG. 7, elements corresponding to those shown in FIGS. 4 and 5 are given the same Reference Numerals, and explanation thereof will be omitted.

As seen from comparison between FIGS. 5 and 7, the embodiment in accordance with the third aspect of the present invention includes a coefficient table 27 associated with the channel filter coefficient setting circuit 25 and for storing the coefficients b(0,1), b(1,1), . . . , b(N,1), b(0,2), b(1,2), . . . b(N,K) of the plurality of imaginary linear phase FIR filters. With this arrangement, at the time of changing the characteristics of the hearing compensating filter, the channel filter coefficient setting circuit 25 refers to the coefficients of the linear phase FIR filters stored in the coefficient table 27, and supplies the respective coefficients of the plurality of linear phase FIR filters to the hearing compensating filter coefficient setting circuit 26. Incidentally, the coefficient table 27 can have a function for communicating with an external device, or alternatively, may be formed of a removable memory such as a ROM, which can be removed from the hearing aid 10, and then, written with the coefficients by an external device, and thereafter, is mounted back into the hearing aid 10.

The method for determining the coefficients of the hearing compensating filter is the same as that of the embodiment of the second aspect of the present invention. The determined coefficients of the hearing compensating filter are supplied to the hearing compensating circuit 22, in which the characteristics of the transposed transversal filter (which is the hearing compensating filter) are changed or modified.

In the third aspect of the present invention, since the coefficients of the plurality of imaginary linear phase filters used for calculating the coefficients of the hearing compensating filter are referred to from the associated coefficient table, the calculation processing for calculating the coefficients of the plurality of imaginary linear phase filters becomes unnecessary. This is a further advantage in addition to the advantage of the second aspect of the present invention.

Figure 8:
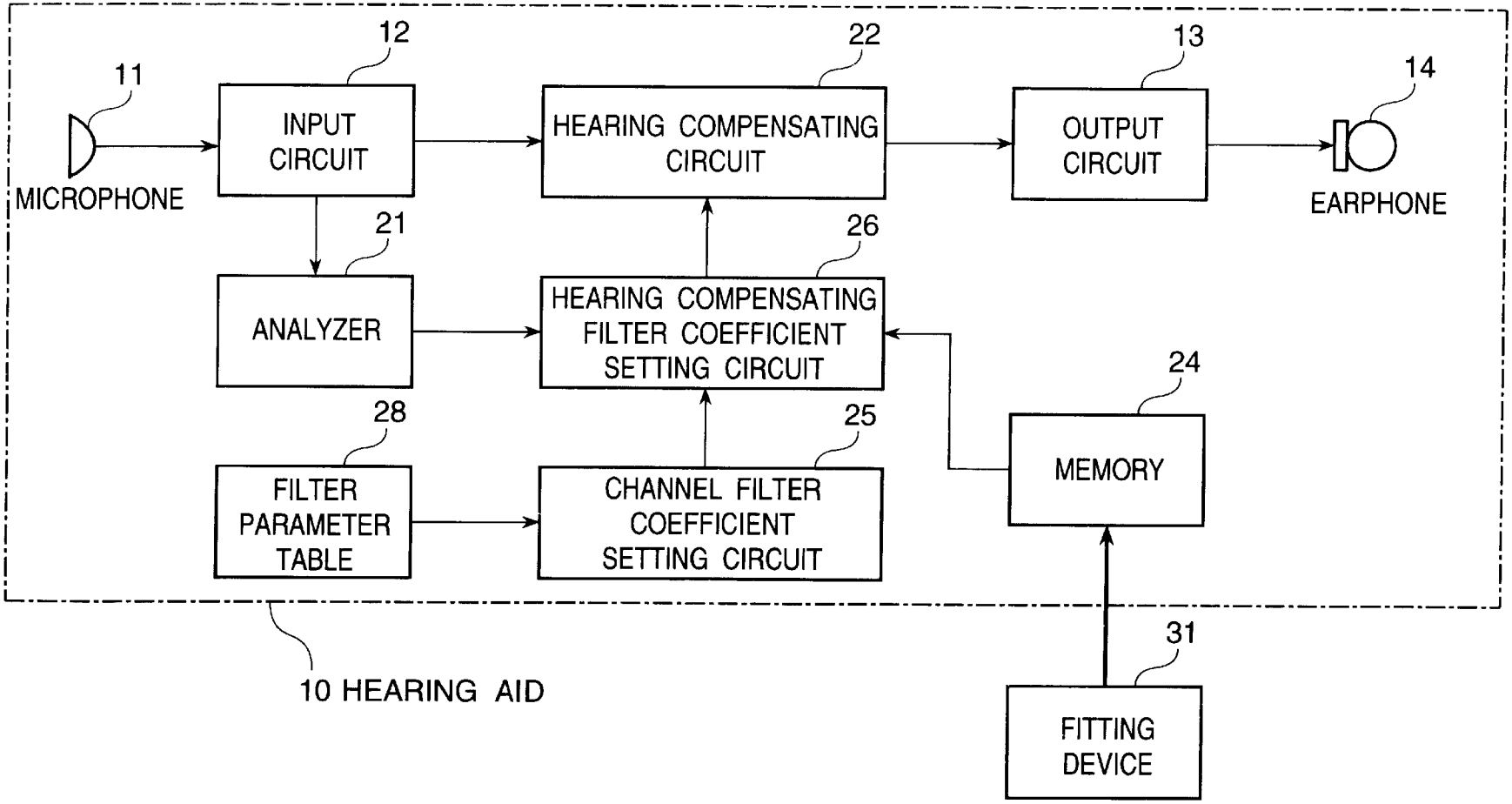
FIG. 8 is a block diagram of an embodiment of the digital hearing aid in accordance with the fourth aspect of the present invention.

Next, an embodiment of the fourth aspect of the present invention will be described with reference to FIG. 8, which is a block diagram of an embodiment of the digital hearing aid in accordance with the fourth aspect of the present invention. In FIG. 8, elements corresponding to those shown in FIGS. 4, 5 and are given the same Reference Numerals, and explanation thereof will be omitted.

As seen from comparison between FIG. 7 and 8, the embodiment of the fourth aspect of the present invention includes a filter parameter table 28 in place of the coefficient table 27 shown in FIG. 7. With this arrangement, at the time of changing the characteristics of the hearing compensating filter, the channel filter coefficient setting circuit 25 reads, from the filter parameter table 28, one or more filter parameters such as a cut-off frequency, a time constant, etc., which determine the characteristics the coefficients of the imaginary linear phase FIR filters, and derives the coefficients of the plurality of imaginary linear phase FIR filters from the read-out parameters. Here, a method for deriving the coefficients of the linear phase FIR filters can be exemplified by a conventional filter design method using a window function, which is widely known as a digital filter designing method.

Incidentally, the filter parameter table 28 can have a function for communicating with an external device, or alternatively, may be formed of a removable memory such as a ROM, which can be removed from the hearing aid 10, and then, written with the parameters by an external device, and thereafter, is mounted back into the hearing aid 10.

The coefficients of the linear phase FIR filters derived in the channel filter coefficient setting circuit 25 are supplied to the hearing compensating filter coefficient setting circuit 26. The method for determining the coefficients of the hearing compensating filter is the same as that of the embodiment of the second aspect of the present invention. The determined coefficients of the hearing compensating filter are supplied to the hearing compensating circuit 22, in which the characteristics of the transposed transversal filer (which is the hearing compensating filter are changed or modified.

In the fourth aspect of the present invention, since the coefficients of the plurality of imaginary linear phase filters used for calculating the coefficients of the hearing compensating filter are calculated from one or more parameters which determine the characteristics of the plurality of imaginary linear phase filters, the memory for storing the coefficients of the plurality of linear phase filters can be omitted, and therefore, the hearing aid can be downsized or miniaturized. This is a further advantage in addition to the advantage of the second aspect of the present invention.

Now, an embodiment of the fifth aspect of the present invention will be described with reference to FIG. 9, which sis a graph illustrating the frequency characteristics of the filters in an embodiment of the digital hearing aid in accordance with the fifth aspect of the present invention.

Figure 9:
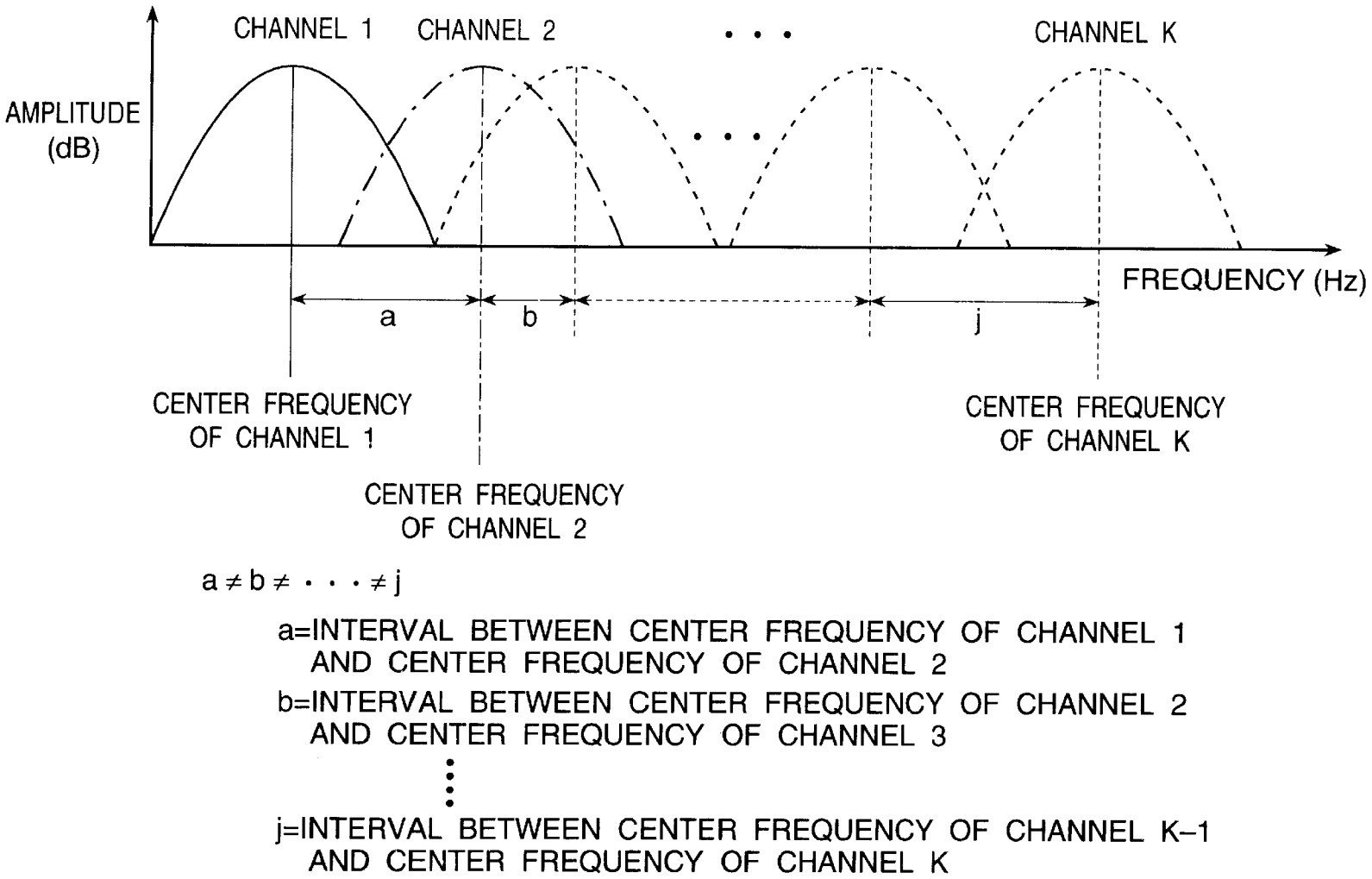
FIG. 9 is a graph illustrating the frequency characteristics of the linear phase filters in an embodiment of the digital hearing aid in accordance with the fifth aspect of the present invention.

In the embodiments of the second, third and fourth aspects of the present invention, the intervals between center frequencies of the plurality of imaginary linear phase FIR filters having the coefficients set by the channel filter coefficient setting circuit 25 are unequal, as shown in FIG. 9. In the graph of FIG. 9, the axis of ordinates indicates the amplitude characteristics of the FIR filters, and the axis of abscissas shows frequency characteristics of the FIR filters. The imaginary FIR filters are designated with "CHANNEL 1", "CHANNEL 2", . . . , "CHANNEL K", the intervals between the center frequencies of the FIR filters "CHANNEL 1", "CHANNEL 2", . . . , "CHANNEL K" are "a", "b", . . . , "j", respectively. Since the center frequency intervals are unequal, the relation of $a \neq b \neq . . . \neq j$ holds.

Accordingly, the coefficients of the plurality of linear phase FIR filters having the respective center frequencies separated from one another with different frequency intervals, are determined by the channel filter coefficient setting circuit 25. The coefficients thus determined are supplied to the hearing compensating filter coefficient setting circuit 26, which in turn determines the coefficients of the transposed transversal filter (which is the hearing compensating filter).

In this fifth embodiment, since the intervals of the center frequencies of the plurality of linear phase filters used for calculating the coefficients of the hearing compensating filter are different, it is possible to reduce the number of imaginary linear phase filters, and therefore, to reduce the amount of processing for calculating the coefficients of the hearing compensating filter. This is a further advantage in addition to the advantage of the second aspect, the advantage of the third aspect and the advantage of the fourth aspect of the present invention.

Next, an embodiment of the sixth aspect of the present invention will be described with reference to FIG. 10, which is a graph illustrating the frequency characteristics of the filters in an embodiment of the digital hearing aid in accordance with the sixth aspect of the present invention.

Figure 10:
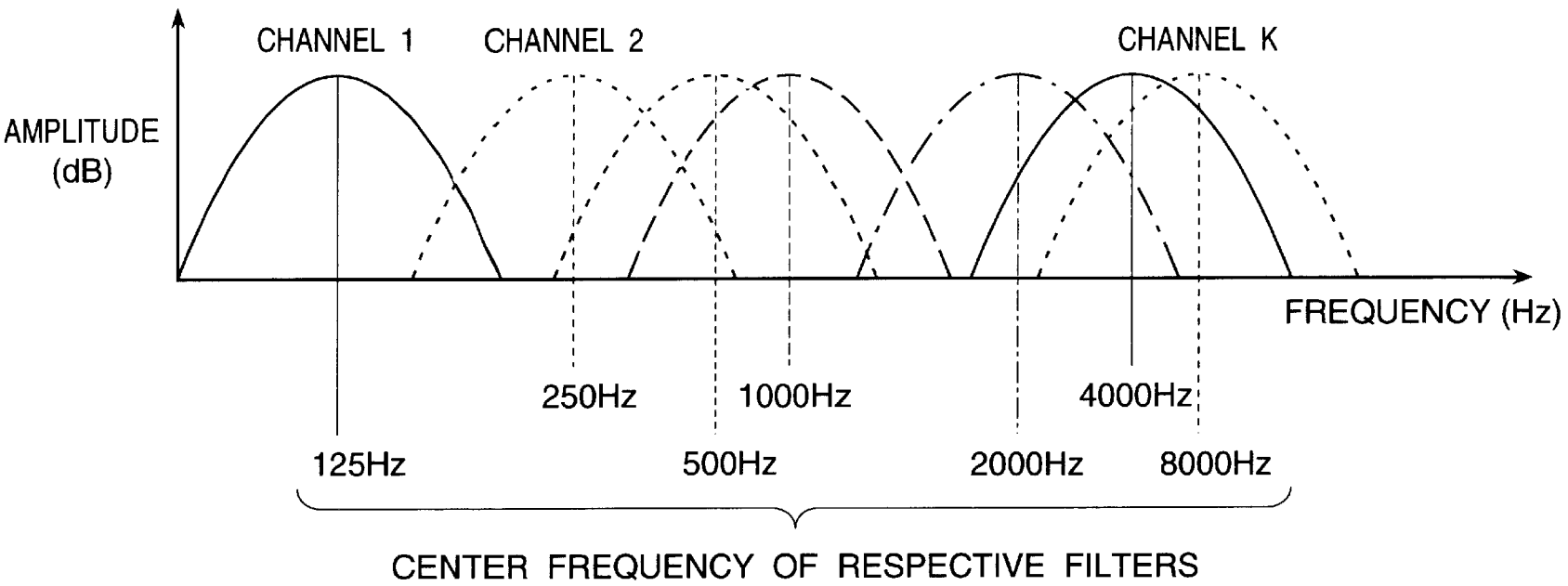
FIG. 10 is a graph illustrating the frequency characteristics of the linear phase filters in an embodiment of the digital hearing aid in accordance with the sixth aspect of the present invention.

In the embodiments of the second, third, fourth and fifth aspects of the present invention, the center frequencies of the plurality of imaginary linear phase FIR filters having the coefficients set by the channel filter coefficient setting circuit 25 are the same as measurement frequencies for the hearing characteristics of the person to be fitted with the hearing aid, as shown in FIG. 10. In the graph of FIG. 10, the axis of ordinates indicates the amplitude characteristics of the FIR filters, and the axis of abscissas shows frequency characteristics of the FIR filters. The imaginary FIR filters are designated with "CHANNEL 1", "CHANNEL 2", . . . , "CHANNEL K". The frequencies indicated below the channel indications "CHANNEL 1", "CHANNEL 2", . . . , "CHANNEL K" are the center frequencies of the imaginary FIR filters "CHANNEL 1", "CHANNEL 2", . . . , "CHANNEL K", and therefore, are the measurement frequencies of an audiogram, which is one of the bearing characteristics.

Accordingly, the coefficients of the plurality of linear phase FIR filters having the center frequencies which are respectively the same as measurement frequencies for the hearing characteristics of the person to be fitted with the hearing aid, are determined by the channel filter coefficient setting circuit 25. The coefficients thus determined are supplied to the hearing compensating filter coefficient setting circuit 26, which in turn determines the coefficients of the transposed transversal filter (which is the hearing compensating filter).

In this sixth embodiment, since the center frequencies of the plurality of linear phase filters used for calculating the coefficients of the hearing compensating filter are made consistent with the measurement frequencies of the hearing characteristics of the person to be fitted with the hearing aid, it is possible to easily cause the characteristics of the hearing compensating filter to match with the hearing characteristics of the person to be fitted with the hearing aid. This is a further advantage in addition to the advantage of the second aspect, the advantage of the third aspect, the advantage of the fourth aspect and the advantage of the fifth aspect of the present invention.

Figure 11:
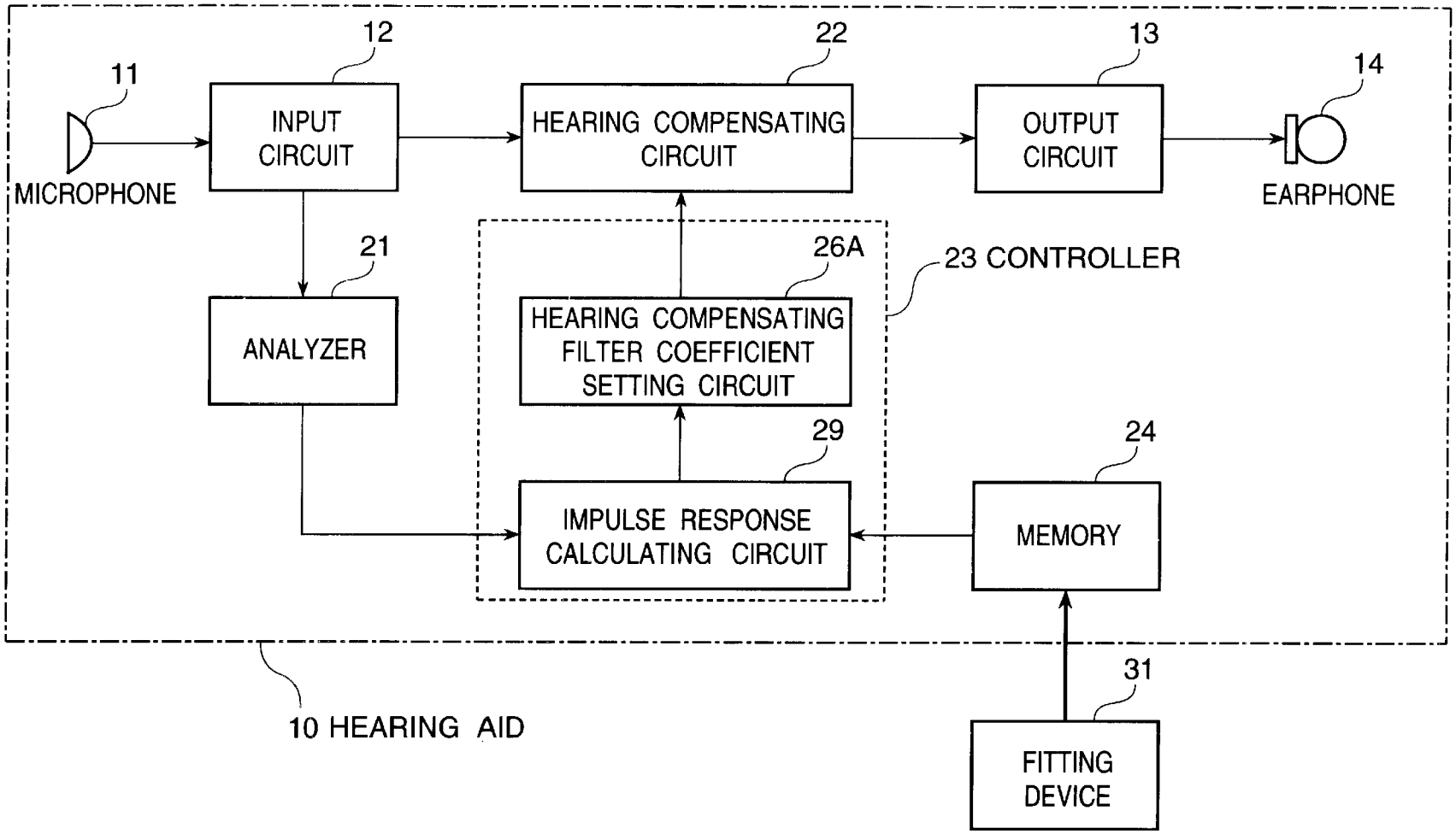
FIG. 11 is a block diagram of an embodiment of the digital hearing aid in accordance with the seventh aspect of the present invention.

Now, an embodiment of the seventh aspect of the present invention will be described with reference to FIG. 11, which is a block diagram of an embodiment of the digital hearing aid in accordance with the seventh aspect of the present invention. In FIG. 11, elements corresponding to those shown in FIG. 4 are given the same Reference Numerals, and explanation thereof will be omitted.

As seen from comparison between FIGS. 4 and 11, in the embodiment of the seventh aspect of the present invention, the controller 23 includes a hearing compensating filter coefficient setting circuit 26A and an impulse response calculating circuit 29.

The impulse response calculating circuit 29 receives the analysis result of the input signal from the analyzer 21 and the hearing characteristics of the person to be fitted with the hearing aid, from the memory 24. On the basis of the analysis result of the input signal and the hearing characteristics of the person to be fitted with the hearing aid, the impulse response calculating circuit 29 determines a frequency characteristics of the hearing compensating filter, and further determines an impulse response by inverse-Fourier-transforming the determined frequency characteristics.

The determined impulse response is supplied to the hearing compensating filter coefficient setting circuit 26A, which determines the coefficients of the hearing compensating filter.

In the seventh aspect of the present invention, since the frequency characteristics of the hearing compensating filter are determined and then inverse-Fourier-transformed to calculate an impulse response thereby to calculate coefficients of the hearing compensating filter, the processing for determining the characteristics of the hearing compensating filter and the calculation processing for the hearing compensating filter can be reduced. This is a further advantage in addition to the advantage of the second aspect of the present invention.

Figure 12:
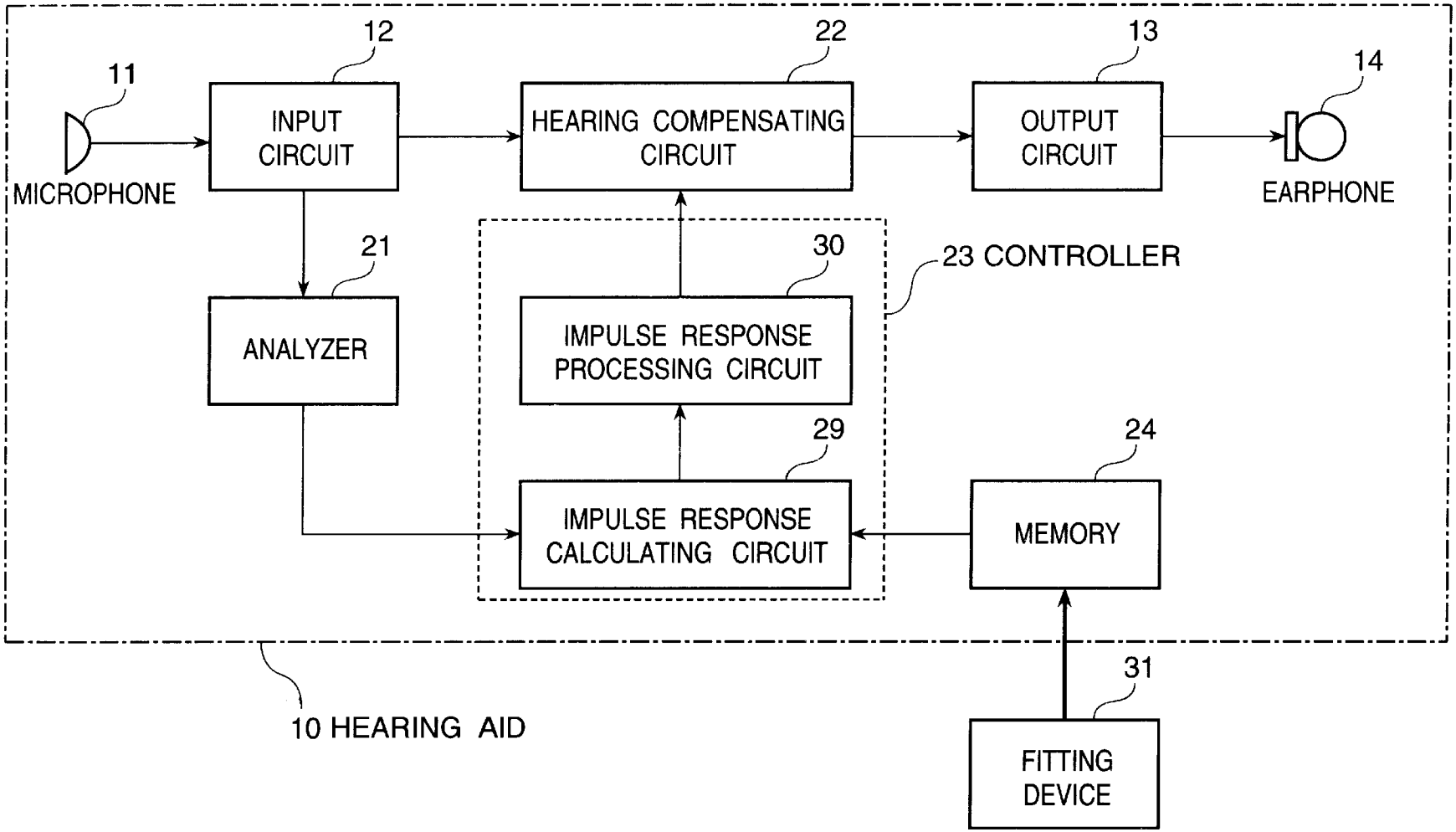
FIG. 12 is a block diagram of an embodiment of the digital hearing aid in accordance with the eight aspect of the present invention.

Next, an embodiment of the eight aspect of the present invention will be described with reference to FIG. 12, which is a block diagram of an embodiment of the digital hearing aid in accordance with the eighth aspect of the present invention. In FIG. 12, elements corresponding to those shown in FIGS. 4 and 11 are given the same Reference Numerals, and explanation thereof will be omitted.

As seen from comparison between FIGS. 4 and 12, in the embodiment of the seventh aspect of the present invention, the controller 23 includes an impulse response calculating circuit 29 and an impulse response processing circuit 30.

The impulse response calculating circuit 29 receives the analysis result of the input signal from the analyzer 21 and the hearing characteristics of the person to be fitted with the hearing aid, from the memory 24. On the basis of the analysis result of the input signal and the hearing characteristics of the person to be fitted with the hearing aid, the impulse response calculating circuit 29 determines frequency characteristics of the hearing compensating filter, and then, determines an impulse response of hearing compensating filter by inverse-Fourier-transforming the determined frequency characteristics. The determined impulse response is supplied to the impulse response processing circuit 30.

This impulse response processing circuit 30 determines a time length of a window from an attenuation envelope of the determined impulse response, and window-processes the impulse response determined by the impulse response calculating circuit 29, by the window having the determined time length, so as to modify the impulse response. On the basis of the impulse response thus modified, the coefficients of the hearing compensating filter are obtained.

The obtained coefficients of the hearing compensating filter are supplied to the hearing compensating circuit 22, in which the characteristics of the transposed transversal filter (which is the hearing compensating filter are changed or modified.

In the eighth aspect of the present invention, the frequency characteristics of the hearing compensating filter are determined, and then the impulse response is determined from the determined frequency characteristics, and further, the time length of the window is calculated from the envelope of the impulse response, and the impulse response is window-processed. Therefore, the amount of calculation for obtaining the coefficients for the transposed transversal filter can be reduced. This is a further advantage in addition to the advantage of the second aspect, the advantage of the third aspect, the advantage of the fourth aspect, the advantage of the fifth aspect, the advantage of the sixth aspect and the advantage of the seventh aspect of the present invention.

The invention has thus been shown and described with reference to the specific embodiments. However, it should be noted that the present invention is in no way limited to the details of the illustrated structures but changes and modifications may be made within the scope of the appended claims.

We claim:

1. A digital hearing aid having variable hearing compensating characteristics, comprising a hearing compensating means having a transposed transversal filter receiving an input signal, for outputting a compensated output signal, an analyzing means receiving said input signal for frequency-analyzing said input signal, a memory means for storing hearing characteristics of a person to be fitted with the hearing aid, and a control means receiving a frequency analysis result of said input signal from said analyzing means and said hearing characteristics from said memory means, for deriving coefficients for said transposed transversal filter to supply said derived coefficients to said transposed transversal filter.

2. A digital hearing aid claimed in claim 1 wherein said control means includes a filter coefficient setting circuit for estimating a plurality of parallel-connected linear phase filters having different pass bands but each having the same structure as that of said transposed transversal filter, and a hearing compensating filter coefficient setting circuit for determining a weight of each of said linear phase filters from said hearing characteristics of the person to be fitted with the hearing aid and said frequency analysis result of said input signal, and for multiplying coefficients of each of said linear phase filters by a corresponding determined weight, and for mutually adding corresponding coefficients of said linear phase filters so as to determine coefficients for said transposed transversal filter.

3. A digital hearing aid claimed in claim 2 further including coefficient table storing said coefficients of each of said linear phase filters so that said coefficients of each of said linear phase filters can be obtained from said coefficient table.

4. A digital hearing aid claimed in claim 2 wherein said control means is configured to estimate said plurality of linear phase filters having respective center frequencies separated from one another with unequal frequency intervals.

5. A digital hearing aid claimed in claim 2 wherein said control means is configured to estimate said plurality of linear phase filters having center frequencies respectively equal to measurement frequencies of the hearing characteristics of the person to be fitted with the hearing aid.

6. A digital hearing aid claimed in claim 5, wherein each of said plurality of linear phase filters is a transposed transversal finite impulse response filter.

7. A digital hearing aid claimed in claim 1, wherein the derived filter coefficients provide for a dynamic changing of the digital hearing aid to adapt to changes in said input signal.

8. A digital hearing aid claimed in claim 7, wherein a sound level of said input signal and a frequency characteristic of said input signal are used to determine the derived filter coefficients, so as to provide an output of the digital hearing aid that is within an audible range of the person to be fitted with the hearing aid, based on the stored hearing characteristics.

9. A digital hearing aid claimed in claim 7, wherein the transposed transversal filter is a transposed transversal Finite Impulse Response Filter, and wherein the derived filter coefficients are at least one of a cut-off frequency and a time constant.

10. A digital hearing aid having variable hearing compensating characteristics, comprising:

an input circuit configured to receive an input sound signal;

a transposed transversal filter configured to receive the input sound signal from the input circuit and to filter the input sound signal to provide a filtered signal;

an analyzer configured to receive the input sound signal from the input circuit and to perform frequency analysis on the input sound signal, the analyzer outputting analysis results based on the frequency analysis;

a memory configured to store information related to hearing characteristics of a user of the digital hearing aid; and a control unit configured to receive the analysis results from the analyzer and the hearing characteristics from the memory, the control unit configured to derive filter coefficients for the transposed transversal filter, wherein dynamic filtering of the input sound signal is provided as a result.

11. A digital hearing aid claimed in claim 10, wherein the control unit includes:

a plurality of parallel-connected linear phase filters having different pass-bands but each having a same structure as that of said transposed transversal filter; and a hearing compensation filter coefficient setting circuit configured to determine a weight of each of the linear phase filters based on the hearing characteristics of the user and the analysis results, and for multiplying coefficients of each of the linear phase filters by a corresponding determined weight, so as to determine coefficients for the transposed transversal filter.

12. The digital hearing aid claimed in claim 11, further including a coefficient table configured to store the coefficients of each of the linear phase filters so that the coefficients of each of the linear phase filters can be obtained from the coefficient table.

13. The digital hearing aid claimed in claim 11, wherein said control unit is configured to estimate the plurality of linear phase filters having respective center frequencies separated from one another with unequal frequency intervals.

14. A digital hearing aid claimed in claim 13, wherein each of said plurality of linear phase filters is a transposed transversal finite impulse response filter.

15. The digital hearing aid claimed in claim 11, wherein the control means is configured to estimate the plurality of linear phase filters having center frequencies respectively equal to measurement frequencies of the hearing characteristics stored in the memory.

16. A digital hearing aid claimed in claim 11, wherein the derived filter coefficients provide for a dynamic changing of the digital hearing aid to adapt to changes in the input sound signal.

17. A digital hearing aid claimed in claim 16, wherein a sound level of the input sound signal and a frequency characteristic of the input sound signal are used to determine the derived filter coefficients, so as to provide an output of the digital hearing aid that is within an audible range of the person to be fitted with the hearing aid, based on the stored hearing characteristics.

18. A digital hearing aid claimed in claim 16, wherein the transposed transversal filter is a transposed transversal Finite Impulse Response Filter, and wherein the derived filter coefficients are at least one of a cut-off frequency and a time constant.

* * * * *